United States Patent [19]

Locatelli et al.

[11] Patent Number: 4,510,646

[45] Date of Patent: Apr. 16, 1985

[54] DEVICE FOR CONTROL OF CONDUCTIVE MATERIALS IN BALE-BREAKER MACHINES

[75] Inventors: Claudio Locatelli, Capriolo; Claudio Dragagna, Pavia, both of Italy

[73] Assignee: F. LLI Marzoli & C. S.P.A., Palazzio Sull'Oglio, Italy

[21] Appl. No.: 501,570

[22] Filed: Jun. 6, 1983

[30] Foreign Application Priority Data

Jun. 8, 1982 [IT] Italy ..... 21750 A/82

[51] Int. Cl.[3] ..... D01G 7/06

[52] U.S. Cl. ..... 19/80 R; 19/81

[58] Field of Search ..... 19/0.2, 0.22, 80 R, 19/81, 64.5, 105, 0.23

[56] References Cited

U.S. PATENT DOCUMENTS 2,102,906 12/1937 Merchant ..... 19/0.22
4,281,437 8/1981 Marx ..... 19/80 R
4,297,767 11/1981 Leifeld ..... 19/80 A
4,400,850 8/1983 Burnett ..... 19/0.23

*Primary Examiner*—Louis K. Rimrodt
*Attorney, Agent, or Firm*—Holman & Stern

[57] ABSTRACT

The present invention proposes a device for control of the presence of conductive bodies or materials in bales for processing in bale-breaker machines equipped with rotating members for the take-off of fibre locks from the bales disposed in a row and also equipped with pressure elements resting on the upper surface of the bales being processed. The device comprises conductance sensors associated with the pressure elements and sensitive to the conductance existing between said elements and forming part of an electric circuit adapted to cause the machine to be acted upon in such a way as to prevent damage to the rotating take-off members when the conductance between any of two contiguous pressure elements exceeds a pre-set value. The result of the machine being acted upon may be the halting of the rotating take-off members and/or a raising of such members and possibly a simultaneous cut-out of the machine.

11 Claims, 4 Drawing Figures

DEVICE FOR CONTROL OF CONDUCTIVE MATERIALS IN BALE-BREAKER MACHINES

The present invention relates to so-called bale-breaker machines which, as is known, automatically remove or take-off locks of fibres from a series of bales of textile fibres, so that the locks can be sent to the ensuing processing steps.

In particular, the invention relates to a control device applicable to such a bale-breaker machine to check for conductive bodies or materials in the bales of textile fibres, such as pieces of metal wire straps or sundry metal items, etc., or very hygroscopic materials.

Bale-breaker machines with horizontal movement above a series of bales disposed in a row have devices for the opening and automatic take-off of the locks from the bales, which devices chiefly consist of rotating reels and of pressure slides or grilles positioned on a trolley mounted in the frame of the bale-breaker machine and having a vertical reciprocal motion. Thus, during the motion of the machine, the said devices take-off the locks of fibre from above the bales and the locks are then conveyed pneumatically to the ensuing processing steps.

Inside the textile fibre bales, especially when the fibres are vegetable fibres, conductive foreign bodies can be present, for example metallic bodies, which can disturb the automatic take-off of the locks of fibre from the bales, thus creating serious difficulties such as for example fires, breakage of the take-off members, choking-up, etc.

When the bales are opened and the contents removed by hand by the operator, these problems do not of course exist, since the operator removes the foreign bodies as and when they present themselves.

The object of the present invention is to provide a control device for automatic bale-breaker machines adapted to detect the presence of conductive bodies or materials in the bales and to cause the machine to be acted upon so as to prevent damage to the rotating take-off members.

In view of this object, the present invention envisages a control device to be applied to a bale-breaker machine equipped with rotating take-off members and pressure elements, said device being characterized by the fact that it comprises conductance sensors associated with the pressure elements and sensitive to the conductance existing between said elements, said conductance sensors forming part of an electric circuit adapted to cause the bale-breaker machine to be acted upon so as to prevent damage to the rotating take-off members when the conductance between any of two contiguous pressure elements exceeds a pre-set value.

The result of the machine's being so acted upon may be the immediate arrest of the rotating take-off members or the raising of the trolley bearing such members so as to distance them from the surface layer of the bales being processed. In both cases provision can also be made for the simultaneous cut-out of the bale-breaker machine by interruption of its rectilinear motion.

The conductance sensors can consist of terminal contacts of a d.c. electric circuit, which contacts are connected alternately to two or more contiguous pressure elements, said electric circuit comprising a remote control adapted to cause the machine to be acted upon, for example by the opening of the supply circuit of the motor actuating the rotating take-off members.

The distance between the contiguous pressure elements is relatively small, for example of the order of a few tens of millimeters, so that if conductor bodies or materials of a certain size are present on the surface layer of the bales, such bodies or materials are intercepted by at least one pair of pressure elements, thus increasing the conductance between two related sensors and thus causing the bale-breaker machine to be acted upon.

Further characteristics and advantages of the invention will become evident from the following description of an example of embodiment illustrated in the attached drawings, in which.

Figure 1:
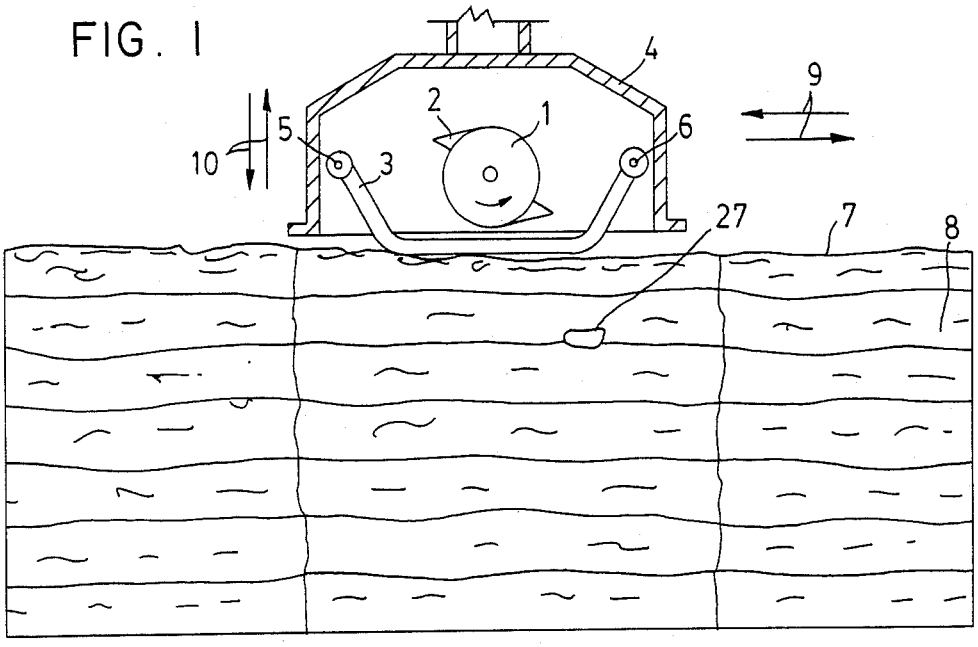
FIG. 1 is an elevated schematic view of the operating members of the bale-breaker machine in a phase of normal work above a series of bales.

The drawings schematically illustrate the operating members of a known bale-breaker machine consisting of a reel 1 with a certain number of take-off members 2 and of pressure elements which in the present instance consist of slides 3. Both the reel 1 and the pressure slides 3 are mounted on a carriage of the bale-breaker machine of which only the frame 4 is shown. The pressure slides 3 have a bracked-like form and are positioned between the take-off members 2 of the reel 1 with a reciprocal distance of for example approximately 25 mm. At their ends, the slides 3 are supported by two parallel rods 5, 6 mounted in the frame 4 with axes parallel to the axis of the reel 1. The take-off members 2 and the pressure slides 3 are intended to work on the upper surface 7 of the series of bales 8 of textile fibres disposed in a row.

The bale-breaker machine has reciprocating rectilinear motion in the direction of the arrows 9 (FIG. 1), while the carriage with the operating members has reciprocating vertical motion in the direction of the arrows 10.

Figure 2:
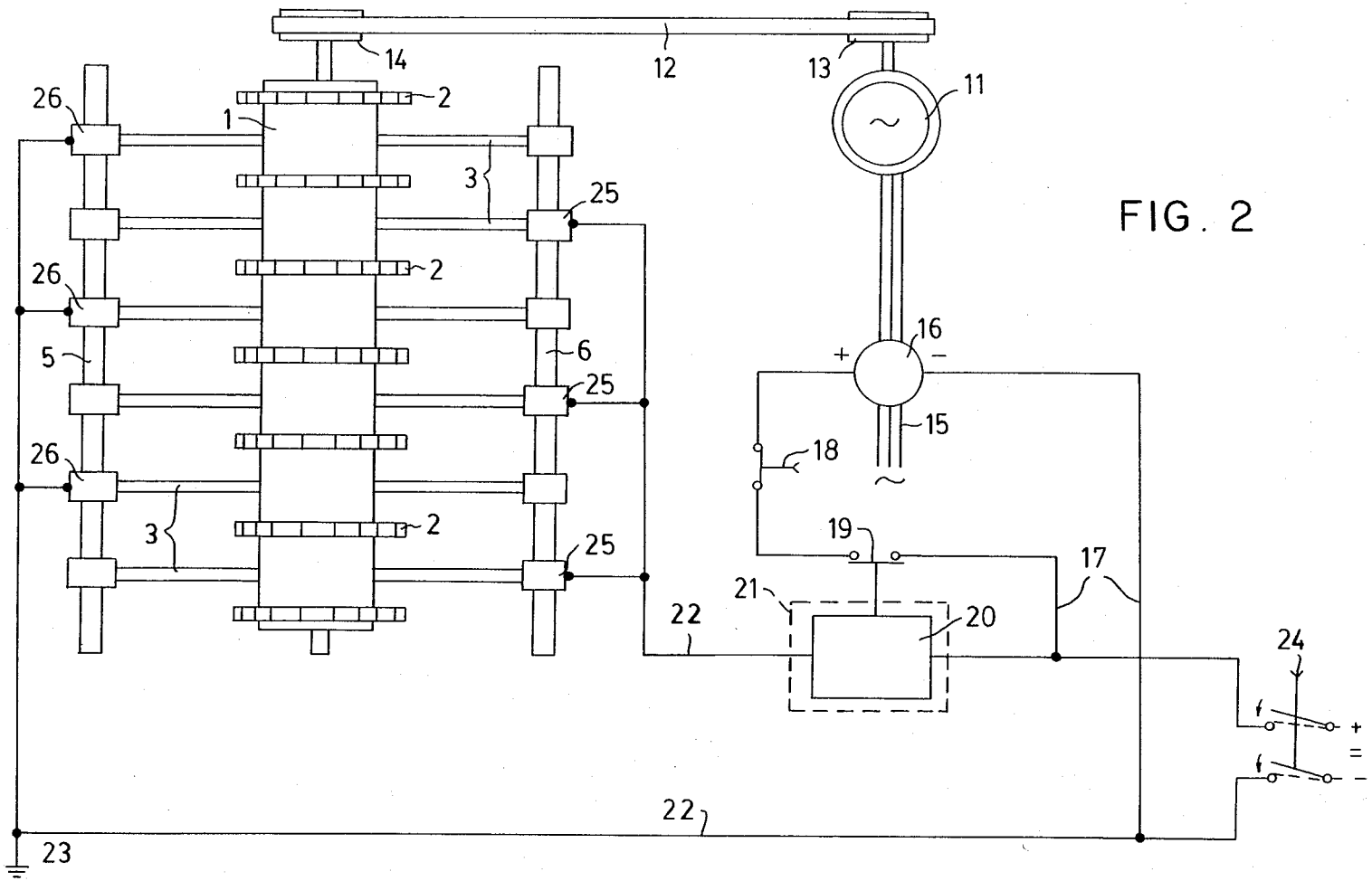
FIG. 2 is a plan view of the same operating members with the schema of the control device in a normal work phase, and FIGS. 3 and 4 correspond respectively to the FIGS. 1 and 2, but in a phase of the presence of a conductive body on the surface layer of the bales and thus in a machine-arrest phase.
Figure 4:
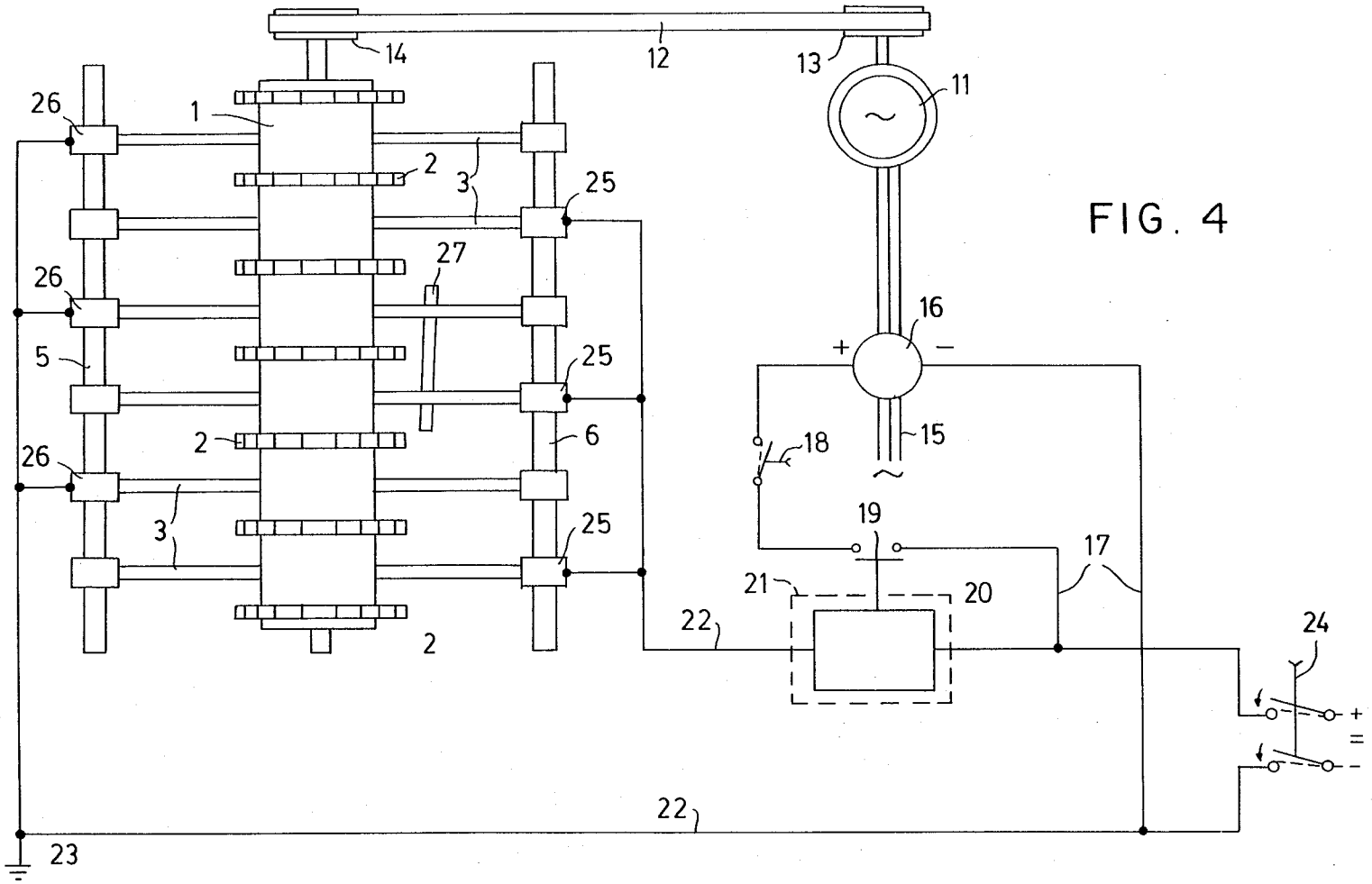

FIGS. 2 and 4 show schematically that the reel 1 can be placed in rotation by a motor 11 through a belt transmission 12 guided by pulleys 13, 14. On the supply line 15 of the motor 11 is connected a remote control switch 16 which can in turn be piloted by a d.c. circuit 17 in which there are connected in series a manual switch 18 and a contact 19 of a relay 20. The coil of this relay 20 receives current from a current amplifier 21 inserted in a second d.c. circuit 22 connected in parallel to the circuit 17. A branch of these parallel circuits 17 and 22 is earthed at 23 and a general switch 24 is fitted at the entry of the two circuits for connection to a source of direct current.

The two branches of the circuit 22 are connected to terminal electric contacts 25 and 26 respectively which are connected alternately to the pressure slides 3: the slides connected to the contacts 26 are earthed, while those connected to the contacts 25 form part of the circuit 22 in which the current amplifier 21 is inserted and which, through the general switch 24, can be connected to the positive pole of the source of direct current.

The pressure slides 3 are of course mounted in an electrically insulated manner on the support rods 5 and 6 and said slides are made of electrically conductive metallic material. It is evident that in this way between each pair of contiguous slides there is full current from the direct current source, when the general switch 24 is closed.

The relay 20 is so calibrated as to keep its contact 19 (see FIG. 2) closed when there is very low electric conductance and this is to say very elevated electrical resistance between the terminal contacts 25–26 and thus between pairs of contiguous slides.

The functioning of the control device is as follows.

During the work of the bale-breaker machine the pressure slides 3 rest on the upper surface of the bales 8 of textile fibres and the general switch 24 as also the manual switch 18 are closed, so that as the contact 19 is normally closed the remote control switch 16 is closed and the motor 11 functions, placing in rotation the reel 1 the take-off members 2 of which take-off locks of fibre from the upper surface 7 of the bales 8, as the bale-breaker machine makes its reciprocal rectilinear motion in the direction of the arrows 9.

If, as is supposed in the conditions illustrated in FIGS. 1 and 2, there are no conductive materials such as metallic foreign bodies, for example straps of metal wire, sundry metal items, etc., on the upper surface 7 of the bales 8, the relay 20—as the conductance between the slides 3 and thus between the terminal contacts 25–26 (which act as conductance sensors) is low—maintains its contact 19 closed and, in consequence, the remote control switch 16 is also closed and supplies the motor 11 which actuates the reel 1.

Figure 3:
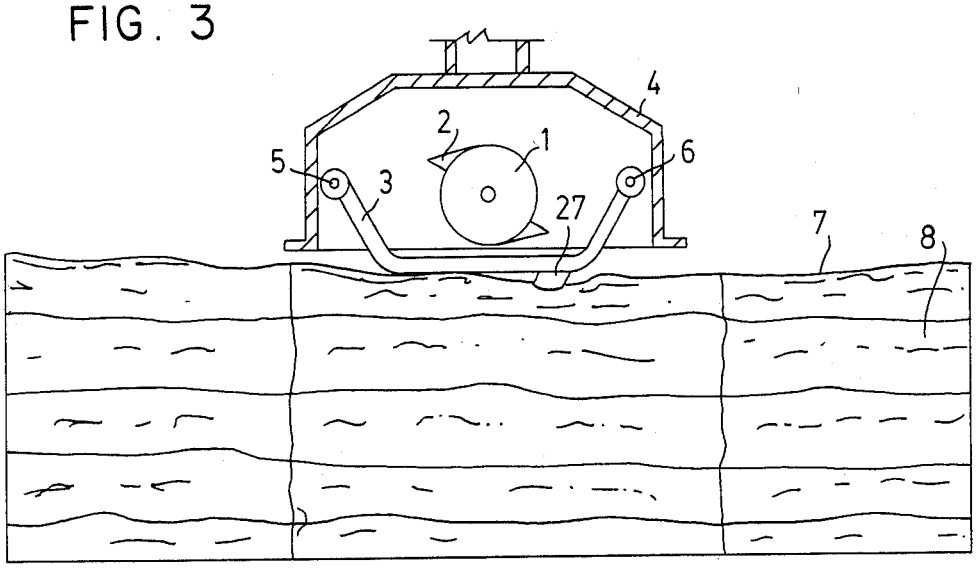

If, on the other hand, for example a conductive metallic body 27 appears on the upper surface 7 of the bales 8 (see FIGS. 3 and 4) and this body 27 is intercepted by any pair of contiguous slides 3, the conductance between the related pair of terminal contacts 25–26 increases, thus permitting the passage of current into the circuit 22. This current is amplified by the current amplifier 21 and, once it has exceeded a pre-set value, the relay 20 is excited and opens its contact 19, interrupting the control circuit 17 of the remote control switch 16: the remote control switch 16 opens and thus arrests the motor 11 and thus also the reel 1 with the take-off members 2. If so desired, the entire bale-breaker machine can also be stopped and there can also be actuated an alarm system to attract the attention of the operator.

The operator must in such case intervene and, in the first place, it is advisable that the manual switch 18 be opened to interrupt the circuit 17 independently of the position of the contact 19. It needs to be noted that the arrest of the reel 1 and possibly of the machine takes place before the take-off members 2 can be damaged by the metallic foreign body 27.

The operator must therefore remove the foreign body 27, with reel 1 and machine stopped, from the upper surface 7 of the bale in question. Subsequently the operator can re-close the switch 18 in order to set the machine working again.

The control device according to the invention is therefore based on the concept of controlling the electrical conductance between a plurality of conductance sensors connected to the pressure elements of the bale-breaker machine, which could also consist of grilles instead of slides. If the conductance between these sensors is low, the machine can work normally, whereas it is immediately arrested if the conductance increases, thus notifying the presence of conductive materials. It follows that the device according to the invention can operate even if very hygroscopic materials are present in the fibrous material being processed.

As previously stated, the intervention in respect of the bale-breaker machine caused by the fact that the control device detects the presence on the upper surface of the bale of a conductive material can also be other than that considered in the example of embodiment described in which the rotation of the reel is stopped.

In effect, such intervention could also consist in a raising of the rotating take-off members so as to take them to a point higher that the upper surface of the bales. In such case, once this raising has been caused as a result of the presence of a conductive material on the upper surface of the bales, the automatic re-lowering of the take-off members as soon as the conductance sensors no longer sense the presence of said materials, must be prevented.

The re-lowering of the take-off members must be controlled by the operator after he has himself removed the foreign material.

The practical embodiment of the device according to the invention should not be considered confined to the example of embodiment described, and can undergo numerous variants within the scope of a person skilled in the art.

We claim:

1. An improvement in a device for detecting the presence of conductive materials in bales of textile fibers for bale-breaker machines having rotating take-off members and elongate bale-pressure elements arranged parallel to each other between said take-off members and substantially perpendicularly to a rotation axis of said take-off members, wherein the improvement comprises conductance sensors associated with said bale-pressure elements and sensitive to the conductance existing between any two adjacent of said bale-pressure elements, each control means responsive to the conductance sensed by each of said sensors to cause the bale-breaker machine to be operative when the conductance between any two adjacent of said bale-pressure elements exceeds a pre-set value, thereby preventing damage to said rotating take-off members by said conductive materials.

2. A device as claimed in claim 1, further including actuation means for said rotating take-off members, and wherein said control means are operatively connected to said actuation means.

3. A device as claimed in claim 1, wherein said control means are operative to cause raising of said rotating take-off members out of contact with said bales.

4. A device as claimed in claim 1, wherein said control means includes means operative to cause cut-out of the bale-breaker machine.

5. A device as claimed in claim 1, wherein each of said bale-pressure elements holds a respective sensor of said conductance sensors, each sensor comprising a terminal contact of a d.c. electric circuit, the terminal contacts held by adjacent bale-pressure elements being alternately connected to two poles of said circuit, said circuit further comprising remote control means for causing the bale-breaker machine to be acted upon.

6. A device as claimed in claim 5, wherein said remote control means comprises a current amplifier and a relay.

7. A device as claimed in claim 6, wherein said relay controls closing of a remote control switch supply circuit, connected in parallel to a d.c. circuit in which said amplifier is connected.

8. A device as claimed in claim 7, wherein a manual switch is arranged in said supply circuit in series with said remote control switch.

9. A device as claimed in claim 7, further comprising: means for controlling said take-off members and including a current supply circuit; and wherein said remote control switch is connected in said supply circuit.

10. A device as claimed in claim 7, wherein said remote control switch is connected in a circuit for controlling raising of said rotating take-off members.

11. A device as claimed in claims 9 or 10, wherein said remote control switch is arranged in a circuit for controlling reciprocal rectilinear movement of a bale-breaker carriage supporting said rotating take-off members.

* * * * *